US011434092B2

(12) United States Patent
Yamamoto

(10) Patent No.: US 11,434,092 B2
(45) Date of Patent: Sep. 6, 2022

(54) SHEET CASSETTE AND IMAGE PROCESSING DEVICE

(71) Applicant: TOSHIBA TEC KABUSHIKI KAISHA, Tokyo (JP)

(72) Inventor: Mikio Yamamoto, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 10 days.

(21) Appl. No.: 16/951,010

(22) Filed: Nov. 18, 2020

(65) Prior Publication Data

US 2022/0153548 A1 May 19, 2022

(51) Int. Cl.

| | |
|---|---|
| ***B65H 1/08*** | (2006.01) |
| ***B65H 11/02*** | (2006.01) |
| ***B65H 9/04*** | (2006.01) |
| ***B65H 1/04*** | (2006.01) |
| ***B65H 5/06*** | (2006.01) |
| ***B65H 1/26*** | (2006.01) |
| *G03G 15/00* | (2006.01) |

(52) U.S. Cl.

CPC ..... *B65H 1/08* (2013.01); *B65H 1/04* (2013.01); *B65H 1/266* (2013.01); *B65H 5/06* (2013.01); *B65H 9/04* (2013.01); *B65H 11/02* (2013.01); *B65H 2405/1117* (2013.01); *B65H 2405/11151* (2013.01); *G03G 15/6502* (2013.01)

(58) Field of Classification Search

CPC ... B65H 1/04; B65H 1/08; B65H 1/14; B65H 1/266; B65H 2405/11151; B65H 2405/1117

See application file for complete search history.

(56) References Cited

U.S. PATENT DOCUMENTS

| | | | | |
|---|---|---|---|---|
| 10,494,206 | B2 * | 12/2019 | Furumoto | G03G 15/6502 |
| 2003/0001330 | A1 * | 1/2003 | Ohfuchi | B65H 1/04 271/162 |
| 2011/0062656 | A1 * | 3/2011 | Shimosato | B65H 1/14 271/157 |
| 2015/0108713 | A1 * | 4/2015 | Yoshitsugu | B65H 1/04 271/217 |
| 2018/0201456 | A1 * | 7/2018 | Okumura | B65H 3/0684 |
| 2022/0041396 | A1 * | 2/2022 | Valenzuela-Rivas | B65H 31/02 |

FOREIGN PATENT DOCUMENTS

| | | |
|---|---|---|
| JP | 2000-185828 | 7/2000 |
| JP | 2001-310825 | 11/2001 |

* cited by examiner

*Primary Examiner* — Prasad V Gokhale

(74) *Attorney, Agent, or Firm* — Amin, Turocy & Watson, LLP

(57) ABSTRACT

According to one embodiment, a sheet cassette includes a sheet placing portion. The sheet placing portion can rotate around a rotation shaft while placing a sheet of a placeable maximum size in a sheet placing area to be flat. The rotation shaft extends to be perpendicular to a discharge direction and a gravity direction of the sheet. The rotation shaft is disposed between a first end portion on a downstream side along the discharge direction in the sheet placing area and a second end portion on an upstream side positioned on a side opposite to the first end portion.

20 Claims, 5 Drawing Sheets

SHEET CASSETTE AND IMAGE PROCESSING DEVICE

FIELD

Embodiments described herein relate generally to a sheet cassette and an image processing device.

BACKGROUND

An image processing device includes a sheet cassette. A sheet contained in the sheet cassette is discharged from the sheet cassette and supplied to an image processing unit of the image processing device. A sheet cassette that can suppress power consumption during the sheet discharge is required.

DETAILED DESCRIPTION

In general, according to one embodiment, a sheet cassette includes a sheet placing portion. The sheet placing portion can rotate around a rotation shaft while placing a sheet of a placeable maximum size in a sheet placing area to be flat. The rotation shaft extends to be perpendicular to a discharge direction and a gravity direction of the sheet. The rotation shaft is disposed between a first end portion on a downstream side along the discharge direction in the sheet placing area and a second end portion on an upstream side positioned on a side opposite to the first end portion.

Hereinafter, an image processing device of the embodiment is described with reference to the drawings.

Figure 1:
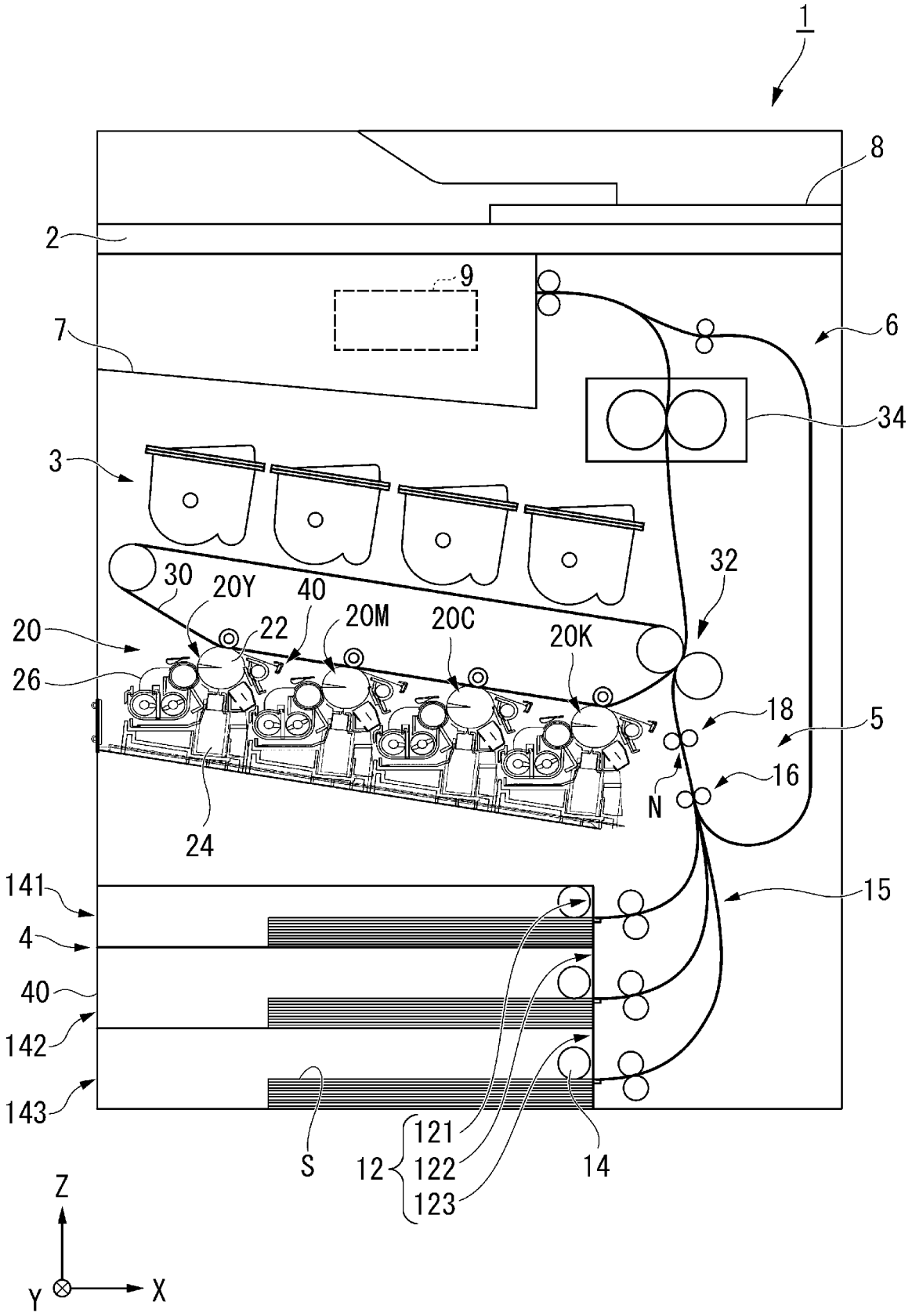
FIG. 1 is a schematic configuration diagram of an image processing device of an embodiment.

FIG. 1 is a schematic configuration diagram of the image processing device of the embodiment. The image processing device of the embodiment is an image forming device 1. The image forming device 1 performs a process of forming an image on a sheet. The image forming device 1 includes a scanner unit 2, an image forming unit 3, a sheet supplying unit 4, a conveyance unit 5, a reversing unit 6, a discharge tray 7, a control panel 8, and a controlling unit 9.

The scanner unit 2 reads image information of an object to be copied based on brightness and darkness of light and generates an image signal. The scanner unit 2 outputs the generated image signal to the image forming unit 3.

The image forming unit 3 forms an image (hereinafter, referred to as a toner image) with a developer including a toner based on an image signal received from the scanner unit 2 and an image signal received from the outside. The image forming unit 3 transfers the toner image on the front surface of a sheet S. The image forming unit 3 fixes the toner image to the sheet S. In this manner, the image forming unit 3 performs an image forming process on the sheet. The configuration of the image forming unit 3 is described below.

The sheet supplying unit 4 supplies the sheets S to the conveyance unit 5 one by one in response to a timing when the image forming unit 3 forms a toner image. The sheet supplying unit 4 includes a sheet cassette 40, a cassette storage unit 12, and a pickup roller 14. The sheet cassette 40 contains the sheet S of a predetermined size and type. The configuration of the sheet cassette 40 is described below. The cassette storage unit 12 stores the sheet cassette 40. The sheet cassette 40 can be inserted to or removed from the cassette storage unit 12. The pickup roller 14 extracts the sheets S from the sheet cassette 40 one by one. The pickup roller 14 supplies the extracted sheet S to the conveyance unit 5.

The conveyance unit 5 conveys the sheet S supplied from the sheet supplying unit 4 to the image forming unit 3. The conveyance unit 5 includes conveyance rollers 16 and registration rollers 18. The conveyance rollers 16 convey the sheet S supplied from the pickup roller 14 to the registration rollers 18. The registration rollers 18 bend the sheet S at a nip N to adjust a position of the distal end in the conveyance direction of the sheet S. The registration rollers 18 convey the sheet S in response to the timing where the image forming unit 3 transfers the toner image to the sheet S.

The configuration of the image forming unit 3 is described.

The image forming unit 3 includes a plurality of electrophotographic process units (hereinafter, referred to as EPUs) 20, exposure devices 24, an intermediate transfer belt (transfer target) 30, the secondary transfer unit 32, and a fixing device 34.

The EPU 20 forms a toner image in response to the image signal from the scanner unit 2 or the outside on a photoconductor drum 22. The plurality of EPUs 20Y, 20M, 20C, and 20K form toner images with toners of yellow, magenta, cyan, and black, respectively. The EPU 20 includes the photoconductor drum 22 and a developing device 26.

The photoconductor drum 22 includes a photosensitive layer on the outer peripheral surface of which the charged state changes by exposure. The exposure device 24 exposes the photoconductor drum 22 and forms an electrostatic latent image on the photoconductor drum 22 in response to an image signal. The developing device 26 develops an electrostatic latent image of the photoconductor drum 22 with the toner and forms the toner image on the photoconductor drum 22.

The intermediate transfer belt 30 is an endless belt that circulates. In a primary transfer unit that is a contact portion between the photoconductor drum 22 and the intermediate transfer belt 30, a toner image of the photoconductor drum 22 is primarily transferred to the intermediate transfer belt 30.

The secondary transfer unit 32 secondarily transfers the toner image primarily transferred to the intermediate transfer belt 30 to the front surface of the sheet S.

The fixing device 34 applies the heat and the pressure to the sheet S and fixes the toner image to the sheet S.

In order to form an image on the back surface of the sheet S, the reversing unit 6 reverses the sheet S discharged from the fixing device 34 and conveys the sheet S toward the registration rollers 18.

The discharge tray 7 places the sheet S discharged with the image formed in the image forming unit 3.

The control panel 8 displays the information relating to the image forming device 1 and receives the input of the information. The control panel 8 receives the input of the information (hereinafter, referred to as size information) relating to the size of the sheet S contained in the sheet cassette 40. The control panel 8 includes a display, a touch panel, various hard keys, and the like.

Figure 2:
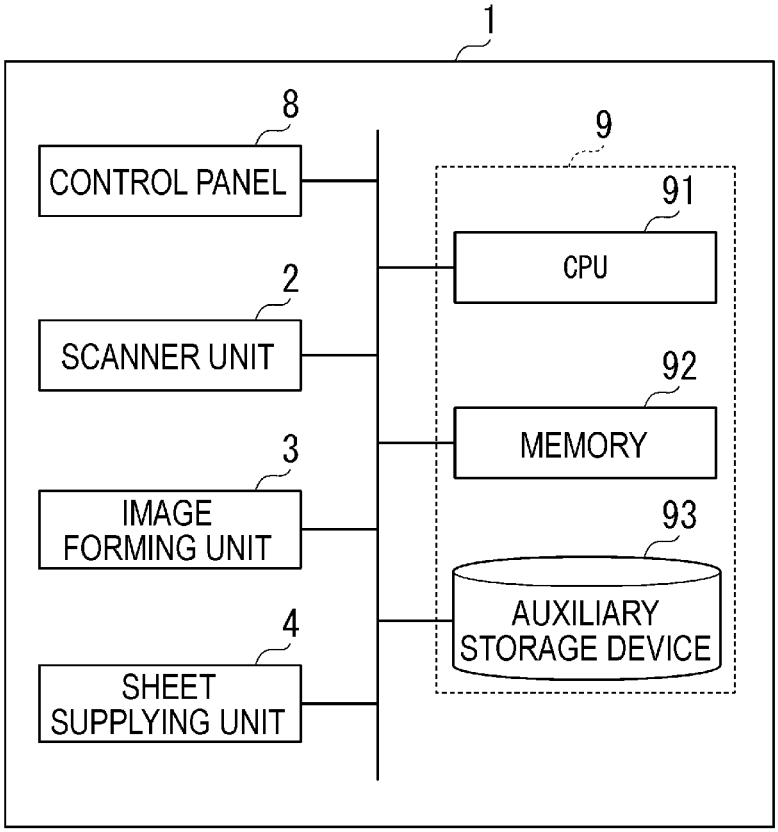
FIG. 2 is a block diagram of an image forming device.

FIG. 2 is a block diagram of the image forming device. The image forming device 1 includes a central processing unit (CPU) 91, a memory 92, and an auxiliary storage device 93 which are connected via buses and executes a program. The image forming device 1 functions as a device including the control panel 8, the scanner unit 2, the image forming unit 3, the sheet supplying unit 4, and the like which are executed by a program.

The CPU 91 functions as the controlling unit 9 by executing a program stored in the memory 92 or the auxiliary storage device 93. The controlling unit 9 controls operations of each functional unit of the image forming device 1.

The auxiliary storage device 93 is configured by using a storage device such as a magnetic hard disk device or a semiconductor storage device. The auxiliary storage device 93 stores information.

The sheet cassette 40 is specifically described.

Figure 3:
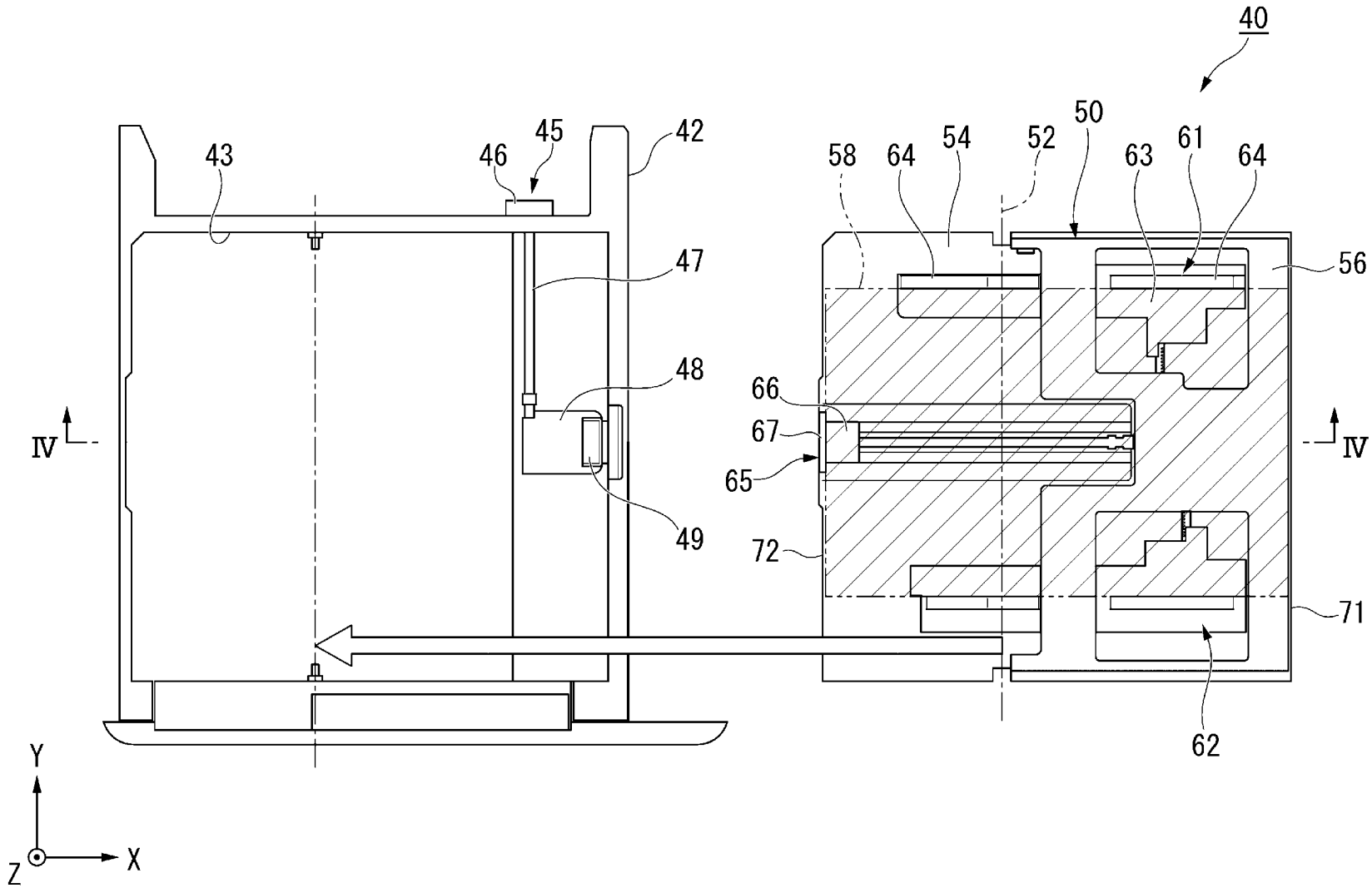
FIG. 3 is a plan view of a state in which a sheet cassette of the embodiment is disassembled.

FIG. 3 is a plan view of a state in which a sheet cassette of the embodiment is disassembled. The sheet cassette 40 includes a frame 42, a sheet placing portion 50, side guides 61 and 62, and an end guide 65. The side guides 61 and 62 and the end guide 65 are mounted to the sheet placing portion 50. In FIG. 3, the sheet cassette 40 is illustrated in a state of being disassembled to the frame 42 and the sheet placing portion 50.

In the present application, the X direction, the Y direction, and the Z direction of the Cartesian coordinate system are defined as follows. The X direction is a direction of discharging the sheet S placed in the sheet placing portion 50. The +X direction is a downstream side in the discharge direction, and the −X direction is an upstream side in the discharge direction. The Z direction is a thickness direction of the sheet S placed in the sheet placing portion 50. The +Z direction is a direction from a lower layer to an upper layer of the plurality of sheets S placed in the sheet placing portion 50. The Y direction is a direction in which the sheet cassette 40 is inserted to and removed from the cassette storage unit 12 of the image forming device 1. The +Y direction is a direction in which the sheet cassette 40 is inserted to the cassette storage unit 12.

The R direction is the circumferential direction of the Y direction. The +R direction is the rotation direction of a right screw that advances in the +Y direction. When the sheet placing portion 50 rotates in the R direction, the sheet placing portion 50 also rotates in the X direction and the Z direction.

The frame 42 is formed in a substantially rectangular shape in a plan view. In the plan view, a through hole 43 is formed in the central portion of the frame 42. The through hole 43 penetrates the frame 42 in the vertical direction.

The frame 42 includes a rotating mechanism 45 that rotates the sheet placing portion 50. The rotating mechanism 45 is disposed in the end portion of the frame 42 corresponding to the +X direction of the sheet placing portion 50. The rotating mechanism 45 includes a coupling 46, a shaft 47, and a rotating plate 48. The coupling 46 is disposed in the end portion in the +Y direction of the frame 42. The coupling 46 is connected to a drive unit (not illustrated) of the image forming device 1. The shaft 47 is disposed in parallel to the Y direction. The shaft 47 connects the coupling 46 and the rotating plate 48. The rotating plate 48 is a central portion in the Y direction of the frame 42 and is disposed along the upper surface of the frame 42. The end portion on the through hole 43 side of the rotating plate 48 is connected to the shaft 47. The rotating plate 48 can rotate in the R direction about the shaft 47.

The sheet placing portion 50 is rotatably supported by the frame 42. The sheet placing portion 50 can rotate around a rotation shaft 52. The rotation shaft 52 is parallel to the Y direction and is perpendicular to the X direction and the gravity direction.

Figure 4:
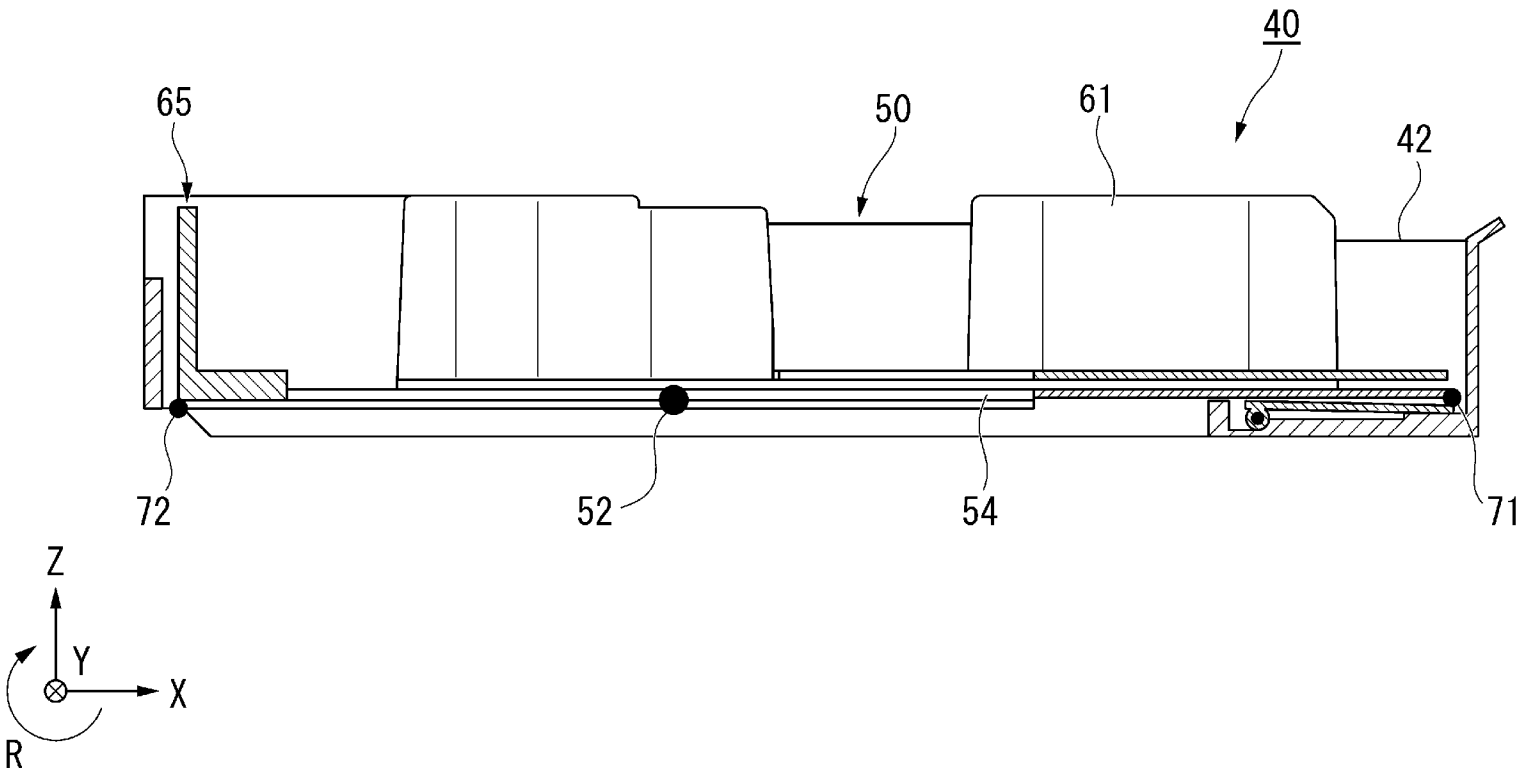
FIG. 4 is a front cross-sectional view of the sheet cassette.

FIG. 4 is a front cross-sectional view of a sheet cassette taken along line IV-IV of FIG. 3. The rotation shaft 52 is a lower end portion of the sheet cassette 40 and the frame 42 and is disposed in the end portion in the −Z direction of the sheet placing portion 50. As illustrated in FIG. 3, the rotation shaft 52 is disposed between a first end portion 71 in the +X direction and a second end portion 72 in the −X direction of a sheet placing area 58 described below. The rotation shaft 52 is disposed in the −X direction with respect to the center in the X direction of the sheet placing portion 50.

The sheet placing portion 50 includes a bottom plate 54 and a tray 56.

The bottom plate 54 is formed in a substantially rectangular shape in a plan view. The bottom plate 54 is rotatably supported by the frame 42. The end portion in the +X direction of the bottom plate 54 is disposed above a rotating plate 48 of a rotating mechanism 45. If the rotating plate 48 rotates in the −R direction, the rotating plate 48 pushes up the bottom plate 54. Accordingly, the bottom plate 54 rotates around the rotation shaft 52 in the −R direction. The end portion in the −X direction of the bottom plate 54 is disposed in the +X direction with respect to the end portion in the −X direction of the through hole 43. The width in the Y direction of the bottom plate 54 is smaller than that in the Y direction of the through hole 43 of the frame 42. If the rotating plate 48 rotates in the −R direction, the end portion in the −X direction of the bottom plate 54 is inserted to the through hole 43. If the sheet placing portion 50 rotates in the −R direction, the first end portion 71 of the sheet placing area 58 is disposed above the second end portion 72.

The center of gravity of the sheet placing portion 50 is in the +X direction with respect to the rotation shaft 52. The sheet placing portion 50 rotates in the +R direction by the gravity. In a state where the bottom plate 54 of the sheet placing portion 50 is in contact with the upper surface of the rotating plate 48, the first end portion 71 and the second end portion 72 of the sheet placing area 58 have the same height. When the sheet placing portion 50 rotates in the +R direction by the gravity, the rotating plate 48 functions as a regulation member that regulates the disposition of the first end portion 71 below the second end portion 72. If the rotating plate 48 regulates the rotation of the sheet placing portion 50, an impact occurs due to the contact between the rotating plate 48 and the bottom plate 54. An elastic member 49 made of an elastic material such as urethane or rubber is disposed on the upper surface of the rotating plate 48. The elastic member 49 functions as a cushioning member that alleviates the impact caused by the regulation of the rotating plate 48. A torque limiter may be disposed on the rotation shaft 52 as a cushioning member.

The side guides 61 and 62 are mounted near the end portion in the ±Y direction of the sheet placing portion 50. The side guides 61 and 62 can rotate together with the sheet placing portion 50. The side guides 61 and 62 include a first side guide 61 and a second side guide 62 that are disposed to be separated in the Y direction. The first side guide 61 is disposed in the +Y direction, and the second side guide 62 is disposed in the −Y direction. The first side guide 61 includes a base plate 63 and a guide plate 64. The base plate 63 is formed in a flat plate shape parallel to the XY plane. The base plate 63 is disposed along the front surface in the +Z direction of the bottom plate 54. The guide plate 64 is formed in a flat plate shape parallel to the XZ plane. The guide plate 64 rises in the +Z direction from the base plate 63. The pair of guide plates 64 and 64 are disposed to be separated from each other in the X direction. The second side guide 62 is formed in the same manner as the first side guide 61.

The pair of side guides 61 and 62 can move in the Y direction. A pinion gear (not illustrated) is disposed between the pair of side guides 61 and 62. A rack (not illustrated) that extends from the pair of side guides 61 and 62 meshes with the pinion gear. The pair of side guides 61 and 62 can move in the Y direction in plane symmetry with the XZ plane passing through the pinion gear as a plane of symmetry. In the state of placing the sheet S in the sheet placing portion 50, the user of the image forming device 1 moves the pair of side guides 61 and 62 in the Y direction. The guide plates 64 of the pair of side guides 61 and 62 are in contact with the end portion in the Y direction of the sheet S. The Y direction is a direction that is parallel to a placing surface of the sheet placing area 58 described below and is perpendicular to the X direction. In this manner, the side guides 61 and 62 can be in contact with the end portion of the sheet S in the Y direction.

The end guide 65 is mounted near the end portion in the −X direction of the sheet placing portion 50. The end guide 65 can rotate together with the sheet placing portion 50. The end guide 65 includes a base plate 66 and a guide plate 67. The base plate 66 is formed in a flat plate shape parallel to the XY plane. The base plate 66 is disposed along the front surface in the +Z direction of the bottom plate 54. The guide plate 67 is formed in a flat plate shape parallel to the YZ plane. The guide plate 67 rises in the +Z direction from the base plate 66.

The end guide 65 can move in the X direction. In a state in which the sheet S is placed in the sheet placing portion 50, the user of the image forming device 1 moves the end guide 65 in the X direction. The guide plate 67 of the end guide 65 is in contact with the end portion in the −X direction of the sheet S. The end guide 65 can be in contact with the end portion of the sheet S in the −X direction.

The tray 56 is formed with a metal material or the like in a substantially flat plate shape. The tray 56 is disposed in parallel to the bottom plate 54 on the front surface in the +Z direction of the bottom plate 54. The relative positions of the tray 56 and the bottom plate 54 are fixed. The tray 56 is disposed in the +Z direction with respect to the base plates 63 of the pair of side guides 61 and 62. A pair of through holes are formed in the tray 56. The guide plates 64 in the +X direction of the pair of side guides 61 and 62 pass through the pair of through holes of the tray 56 and extend in the +Z direction of the tray 56. The tray 56 is disposed in the +X direction of the rotation shaft 52. The tray 56 may be disposed across the ±X direction of the rotation shaft 52.

As described above, the user of the image forming device 1 moves the guide plates 64 of the side guides 61 and 62 in the Y direction and is in contact with the end portion in the Y direction of the sheet S. The sheet S is placed in the +Z direction of the tray 56, and the tray 56 is disposed in the +Z direction of the base plates 63 of the side guides 61 and 62. The sheet S and the base plates 63 of the side guides 61 and 62 are disposed to be separated from each other in the Z direction. When the user moves the side guides 61 and 62 in the Y direction, the intervention between the base plate 63 and the sheet S is suppressed.

The sheets S of various sizes can be placed in the sheet placing portion 50. The sheet S of the maximum size that can be placed in the sheet placing portion 50 is placed in the central portion in the Y direction of the sheet placing portion 50 and the substantially entire area in the X direction. The placing area of the sheet S of the maximum size is the sheet placing area 58 of the sheet placing portion 50. In FIG. 3, the sheet placing area 58 is hatched. The sheet S of a smaller size than the maximum size is placed in the central portion in the Y direction of the sheet placing area 58 and the end portion in the +X direction.

The operation of the sheet cassette 40 is described.

The user of the image forming device 1 places the sheet S in the sheet placing portion 50. The sheet S is placed to be parallel to the sheet placing area 58. The user moves the pair of side guides 61 and 62 in the Y direction and causes the side guides 61 and 62 to be in contact with the both end portions in the Y direction of the sheet S. The user moves the end guide 65 in the X direction and causes the end guide 65 to be in contact with the end portion in the −X direction of the sheet S. The user inserts the sheet cassette 40 to the cassette storage unit 12 of the image forming device 1. A coupling 46 of the rotating mechanism 45 of the sheet cassette 40 is connected to the drive unit of the image forming device 1. External force (driving torque) is input to the coupling 46 from the drive unit.

Figure 5:
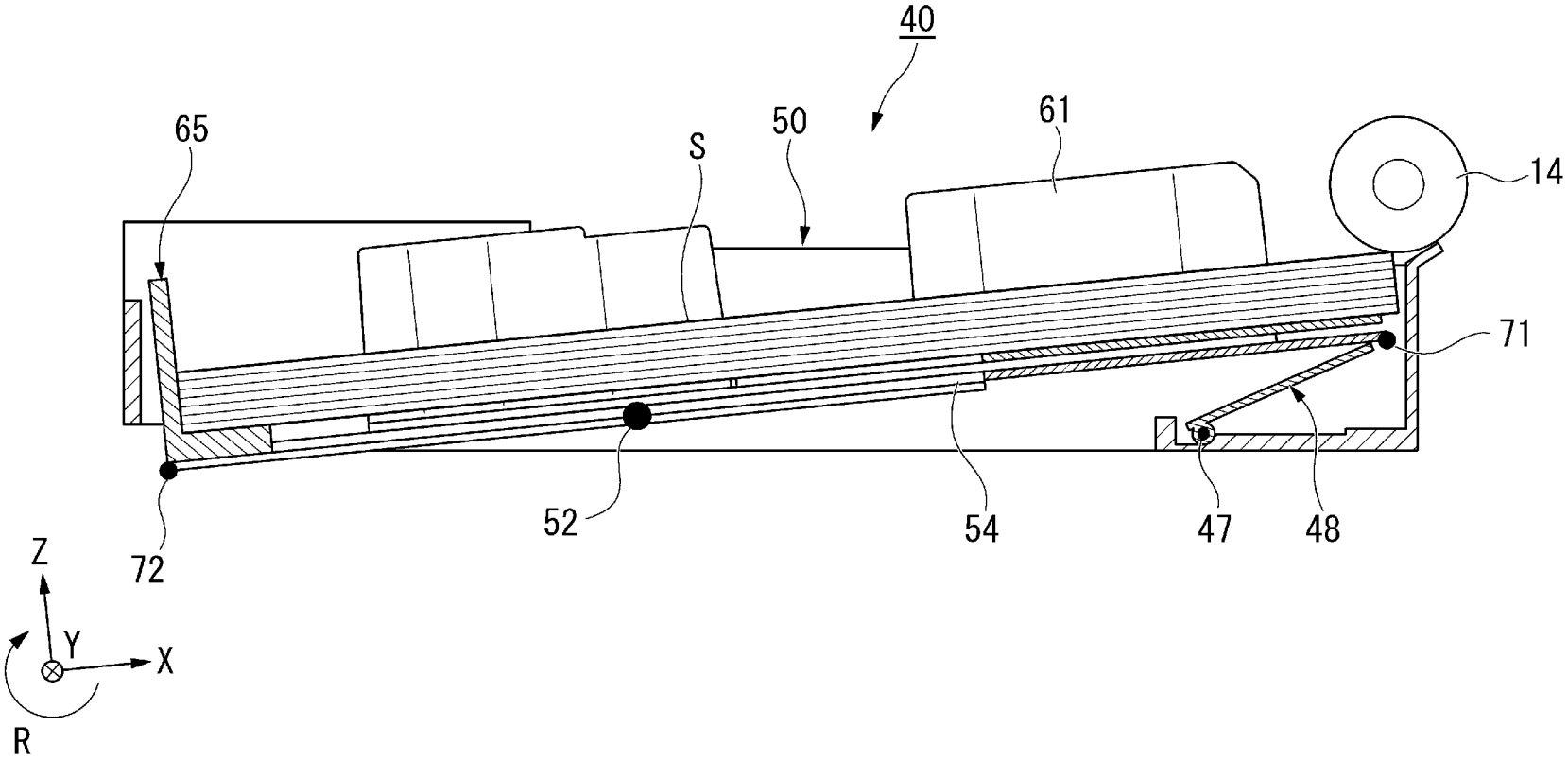
FIG. 5 is an operation explanatory diagram of the sheet cassette.

FIG. 5 is an operation explanatory diagram of a sheet cassette. A shaft 47 rotates in the −R direction by the input of the external force, and the rotating plate 48 rotates in the −R direction. The rotating plate 48 pushes up the bottom plate 54 of the sheet placing portion 50. The sheet placing portion 50 rotates in the −R direction about the rotation shaft 52. The sheet placing portion 50 rotates so that the first end portion 71 in the +X direction of the sheet placing area 58 is disposed above the second end portion 72 in the −X direction. As described above, the rotation shaft 52 is disposed between the first end portion 71 and the second end portion 72 of the sheet placing area 58. Therefore, the sheet placing portion 50 rotates in the −R direction by small external force.

Since the entire sheet placing area 58 rotates, the sheet S placed in the sheet placing area 58 rotates in the flat state without change. The same is applied to a case where the sheet S of the maximum size that can be placed in the sheet placing portion 50 is placed in the sheet placing area 58. The sheet placing portion 50 can rotate around the rotation shaft 52 while holding the sheet S of the maximum size to be flat without deformation. The same is applied when the sheet S is thick paper. The sheet placing portion 50 can rotate around the rotation shaft 52 while holding the sheet S of the thick paper to be flat without deformation.

The sheet placing portion 50 rotates until the end surface in the +Z direction of the sheet S reaches the lower end portion of the pickup roller 14. The position of the end surface in the +Z direction of the sheet S is detected by a sheet sensor (not illustrated) disposed near the pickup roller 14. The controlling unit 9 controls the rotation amount of the sheet placing portion 50 by controlling the operation of the drive unit.

The user inputs size information of the sheet S contained in the sheet cassette 40 to the control panel 8. The controlling unit 9 stores the size information of the sheets S contained in each sheet cassette 40. The user inputs an image forming (printing) command to the control panel 8. The controlling unit 9 supplies the sheet S from the sheet cassette 40 containing the sheet S of the required size and forms an image.

As illustrated in FIG. 1, the image forming device 1 includes a plurality of cassette storage units 121, 122, and 123. The plurality of cassette storage units 121, 122, and 123 are a first cassette storage unit 121, a second cassette storage unit 122, and a third cassette storage unit 123. The second cassette storage unit 122 is formed below the first cassette storage unit 121. The third cassette storage unit 123 is formed below the second cassette storage unit 122. A first sheet cassette 141 is stored in the first cassette storage unit 121. A second sheet cassette 142 is stored in the second cassette storage unit 122. A third sheet cassette 143 is stored in the third cassette storage unit 123.

The sheet S is discharged from the sheet cassettes 141, 142, and 143 in the +X direction and reaches the conveyance rollers 16 with the direction converted vertically. The sheet S discharged from the first sheet cassette 141 reaches the conveyance rollers 16 immediately after the direction conversion. If the sheet S is the thick paper, it is difficult to control the posture of the sheet S from the first sheet cassette 141 to the conveyance rollers 16. It is preferable that the sheet cassette 40 of the embodiment is stored in the cassette storage units 122 and 123 excluding the first cassette storage unit 121 disposed in the uppermost portion, among the plurality of cassette storage units 121, 122, and 123. It is preferable that the sheet cassette 40 of the embodiment is the second sheet cassette 142 stored in the second cassette storage unit 122. The sheet S discharged from the second sheet cassette 142 reaches the conveyance rollers 16 via a straight conveyance path 15 after the direction conversion. Since the sheet S passes through the straight conveyance path 15, even if the sheet S is the thick paper, the posture of the sheet S is easily controlled.

As described above, the sheet placing portion 50 of the sheet cassette 40 rotates. The rotation shaft 52 of the sheet placing portion 50 is disposed in the lower end portion of the sheet cassette 40. The second end portion 72 in the −X direction of the sheet placing area 58 rotates below the rotation shaft 52. The third cassette storage unit 123 is disposed in the lower end portion of the image forming device 1. If the sheet cassette 40 of the embodiment is the third sheet cassette 143, it is difficult to secure a rotation space of the sheet placing portion 50 below the third cassette storage unit 123. It is preferable that the sheet cassette 40 of the embodiment is stored in the cassette storage units 121 and 122 excluding the third cassette storage unit 123 disposed in the lowermost portion among the plurality of cassette storage units 121, 122, and 123. It is preferable that the sheet cassette 40 of the embodiment is the second sheet cassette 142 stored in the second cassette storage unit 122. Since the third cassette storage unit is present below the second cassette storage unit 122, the rotation space of the sheet placing portion 50 is easily secured.

When the sheet S replenished in the sheet cassette 40, the user pulls out the sheet cassette 40 from the cassette storage unit 12. The connection between the coupling 46 of the sheet cassette 40 and the drive unit of the image forming device 1 is cancelled. The sheet placing portion 50 rotates in the +R direction by the gravity. The sheet placing portion 50 comes into contact with the rotating plate 48, and the rotation of the sheet placing portion 50 stops. The first end portion 71 and the second end portion 72 of the sheet placing area 58 have the same height, and the sheet placing portion 50 is horizontal. In the horizontal state of the sheet placing portion 50, the sheet cassette 40 pulls out from the cassette storage unit 12. When the sheet cassette 40 is pulled out, the intervention between the sheet placing portion 50 and the member around the sheet placing portion 50 is suppressed.

The sheet cassette 40 of the embodiment includes the sheet placing portion 50. The sheet placing portion 50 can rotate the sheet S around the rotation shaft 52 while placing the sheet S of the placeable maximum size in the sheet placing area 58 to be flat. The rotation shaft 52 is perpendicular to the X direction and the gravity direction. The rotation shaft 52 is disposed between the first end portion 71 in the +X direction in the sheet placing area 58 and the second end portion 72 in the −X direction in the sheet placing area 58.

The sheet placing portion 50 rotates while holding the sheet S to be flat, the sheet S comes close to the pickup roller 14, and the pickup roller 14 discharges the sheet S. Even if the sheet S of the maximum size is placed, the sheet S is held to be flat, and thus the resistance during the discharge of the sheet can be suppressed. Since the sheet S is discharged at a predetermined timing and a predetermined posture, defective discharge of the sheet S is suppressed.

The rotation shaft 52 of the sheet placing portion 50 is disposed between the first end portion 71 and the second end portion 72 of the sheet placing area 58. Even if the sheet S of the maximum size is placed, the sheet placing portion 50 can rotate by small external force. Therefore, power consumption during the sheet discharge is suppressed.

The sheet cassette 40 includes the side guides 61 and 62. The side guides 61 and 62 are in contact with the end portion of the sheet S in the Y direction. The side guides 61 and 62 can rotate together with the sheet placing portion 50.

The sheet cassette 40 includes the end guide 65. The end guide 65 can be in contact with the end portion of the sheet S in the −X direction. The end guide 65 can rotate together with the sheet placing portion 50.

According to this configuration, the sheet S and the side guides 61 and 62, and the end guide 65 rotate while being in contact with each other without relative movement. Therefore, during the rotation of the sheet placing portion 50, the sheet S is held to be flat.

The sheet placing portion 50 can rotate so that the first end portion 71 is to be disposed above the second end portion 72 by the input of external force. The center of gravity of the sheet placing portion 50 is in the +X direction with respect to the rotation shaft 52. The sheet placing portion 50 rotates by the gravity if an input of external force is cut off.

If the sheet cassette 40 is inserted to the cassette storage unit 12, the external force is input to the sheet placing portion 50. The sheet placing portion 50 rotates in the −R direction by external force, the sheet S comes close to the pickup roller 14, and the pickup roller 14 discharges the sheet S. If the sheet cassette 40 is pulled out from the image forming device 1, the input of external force to the sheet placing portion 50 is cut off, and the sheet placing portion 50 rotates in the +R direction by gravity. When the sheet cassette 40 is pulled out, intervention between the sheet placing portion 50 and the member around the sheet placing portion 50 is suppressed.

The sheet cassette 40 includes the rotating plate 48. When the sheet placing portion 50 rotates by gravity, the rotating plate 48 regulates the disposition of the first end portion 71 below the second end portion 72.

In a horizontal state of the sheet placing portion 50, the sheet cassette 40 is pulled out from the cassette storage unit 12. When the sheet cassette 40 is pulled out, the intervention between the sheet placing portion 50 and a member around the sheet placing portion 50 is suppressed.

The sheet cassette 40 includes the elastic member 49. The elastic member 49 alleviates the impact by the regulation of the rotating plate 48.

When the sheet cassette 40 is pulled out, the generation of an impact sound according to the rotation regulation of the sheet placing portion 50 is suppressed.

The image forming device 1 of the embodiment includes the sheet cassette 40 described below.

The power consumption during the sheet discharge of the image forming device 1 is suppressed by the sheet cassette 40 described above.

The image forming device 1 includes the first cassette storage unit 121 and the second cassette storage unit 122. The second cassette storage unit 122 forms below the first cassette storage unit 121. The sheet cassette 40 is not stored in the first cassette storage unit 121. The sheet cassette 40 is stored in the second cassette storage unit 122.

The sheet S discharged from the sheet cassette 40 of the second cassette storage unit 122 reaches the conveyance rollers 16 via the straight conveyance path 15 after the direction conversion. Since the sheet S passes through the straight conveyance path 15, even if the sheet S is the thick paper, the posture of the sheet S is easily controlled.

The image forming device 1 includes the third cassette storage unit 123. The third cassette storage unit 123 is formed below the second cassette storage unit 122. The sheet cassette 40 is not stored in the third cassette storage unit 123.

According to this configuration, a rotation space of the sheet placing portion 50 of the sheet cassette 40 of the second cassette storage unit 122 is easily secured below the second cassette storage unit 122.

The image forming device 1 includes the sheet cassette 40 and the cassette storage unit 12 that stores the sheet cassette 40 described below. When the sheet cassette 40 is pulled out from the cassette storage unit 12, the sheet placing portion 50 rotates by the gravity.

According to this configuration, when the sheet cassette 40 is pulled out, the intervention between the sheet placing portion 50 and a member around the sheet placing portion 50 is suppressed.

The image processing device of the embodiment is the image forming device 1. Accordingly, the image processing device may be the decoloring device. The decoloring device executes a process of decoloring (erasing) an image formed on the sheet with a decolorable toner.

At least one embodiment described above includes the rotation shaft 52 of the sheet placing portion 50 disposed between the first end portion 71 and the second end portion 72 of the sheet placing area 58. Accordingly, the power consumption during the sheet discharge can be suppressed.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet cassette, comprising:

a sheet placing portion, upon which sheets are placed, configured to rotate around a rotation shaft while a sheet of a placeable maximum size is placed in a sheet placing area of the sheet placing portion that is flat, and wherein the rotation shaft extends perpendicularly to a discharge direction and a gravity direction of the sheet and is positioned between a first end portion on a downstream side along the discharge direction in the sheet placing area and a second end portion on an upstream side positioned on a side opposite to the first end portion; and side guides configured to be in contact with an end portion of the sheet in a direction parallel to a placing surface of the sheet placing area and perpendicular to the discharge direction, the side guides are mounted to a top surface of the sheet placing area, wherein the side guides are configured to rotate together with the sheet placing portion.

2. The sheet cassette according to claim 1, further comprising:

an end guide configured to be in contact with an end portion on an upstream side of the sheet along the discharge direction, wherein the end guide is configured to rotate together with the sheet placing portion.

3. The sheet cassette according to claim 1, wherein the sheet placing portion rotates by an input of external force so that the first end portion is disposed above the second end portion, a center of gravity of the sheet placing portion is on a downstream side in the discharge direction with respect to the rotation shaft, and the sheet placing portion rotates by gravity when the input of the external force is terminated.

4. The sheet cassette according to claim 3, further comprising:

a regulation member configured to regulate disposition of the first end portion below the second end portion, when the sheet placing portion rotates by gravity.

5. The sheet cassette according to claim 4, further comprising:

a cushioning member configured to alleviate an impact by the regulation of the regulation member.

6. An image processing device, comprising:

an image forming component; and a sheet cassette, comprising:

a sheet placing portion configured to rotate around a rotation shaft while a sheet of a placeable maximum size is placed in a sheet placing area that is flat, wherein the rotation shaft extends perpendicularly to a discharge direction and a gravity direction of the sheet and is positioned between a first end portion on a downstream side along the discharge direction in the sheet placing area and a second end portion on an upstream side positioned on a side opposite to the first end portion, an end guide configured to be in contact with an end portion on an upstream side of the sheet along the discharge direction, and wherein the end guide is configured to rotate together with the sheet placing portion.

7. The image processing device according to claim 6, further comprising:

a first cassette storage component configured not to store the sheet cassette; and a second cassette storage component formed below the first cassette storage component and configured to store the sheet cassette.

8. The image processing device according to claim 7, further comprising:

a third cassette storage component formed below the second cassette storage component and configured to not to store the sheet cassette.

9. The image processing device according to claim 6, further comprising:

side guides configured to be in contact with an end portion of the sheet in a direction parallel to a placing surface of the sheet placing area and perpendicular to the discharge direction, wherein the side guide is configured to rotate together with the sheet placing portion.

10. The image processing device according to claim 6, wherein the sheet placing portion rotates by an input of external force so that the first end portion is disposed above the second end portion, a center of gravity of the sheet placing portion is on a downstream side in the discharge direction with respect to the rotation shaft, and the sheet placing portion rotates by gravity when the input of the external force is terminated.

11. The image processing device according to claim 10, further comprising:

a regulation member configured to regulate disposition of the first end portion below the second end portion, when the sheet placing portion rotates by gravity.

12. The image processing device according to claim 11, further comprising:

a cushioning member configured to alleviate an impact by the regulation of the regulation member.

13. An image processing device, comprising:

an image forming component;

a sheet cassette, comprising:

a sheet placing portion configured to rotate around a rotation shaft while a sheet of a placeable maximum size is placed in a sheet placing area that is flat, and wherein the rotation shaft extends perpendicularly to a discharge direction and a gravity direction of the sheet and is positioned between a first end portion on a downstream side along the discharge direction in the sheet placing area and a second end portion on an upstream side positioned on a side opposite to the first end portion, the sheet placing portion rotates by an input of external force so that the first end portion is disposed above the second end portion, a center of gravity of the sheet placing portion is on a downstream side in the discharge direction with respect to the rotation shaft, the sheet placing portion rotates by gravity when the input of the external force is terminated, an end guide configured to be in contact with an end portion on an upstream side of the sheet along the discharge direction, wherein the end guide is configured to rotate together with the sheet placing portion; and a cassette storage component configured to store the sheet cassette, wherein, when the sheet cassette is pulled out from the cassette storage component, the sheet placing portion rotates by gravity.

14. The image processing device according to claim 13, further comprising:

a regulation member configured to regulate disposition of the first end portion below the second end portion, when the sheet placing portion rotates by gravity.

15. The image processing device according to claim 14, further comprising:

a cushioning member configured to alleviate an impact by the regulation of the regulation member.

16. The image processing device according to claim 13, further comprising:

a first cassette storage component configured not to store the sheet cassette; and a second cassette storage component formed below the first cassette storage component and configured to store the sheet cassette.

17. The image processing device according to claim 16, further comprising:

a third cassette storage component formed below the second cassette storage component and configured to not to store the sheet cassette.

18. The image processing device according to claim 13, wherein the sheet placing portion rotates by an input of external force so that the first end portion is disposed above the second end portion, a center of gravity of the sheet placing portion is on a downstream side in the discharge direction with respect to the rotation shaft, and the sheet placing portion rotates by gravity when the input of the external force is terminated.

19. The image processing device according to claim 18, further comprising:

a regulation member configured to regulate disposition of the first end portion below the second end portion, when the sheet placing portion rotates by gravity.

20. The image processing device according to claim 19, further comprising:

a cushioning member configured to alleviate an impact by the regulation of the regulation member.

* * * * *